US008678012B2

(12) United States Patent
Li et al.

(10) Patent No.: US 8,678,012 B2
(45) Date of Patent: Mar. 25, 2014

(54) TOBACCO SOLUTION ATOMIZING DEVICE FOR ELECTRONIC CIGARETTE

(76) Inventors: Yonghai Li, Guangdong (CN); Zhongli Xu, Guangdong (CN)

( * ) Notice: Subject to any disclaimer, the term of this patent is extended or adjusted under 35 U.S.C. 154(b) by 818 days.

(21) Appl. No.: 12/914,899

(22) Filed: Oct. 28, 2010

(65) Prior Publication Data

US 2011/0303231 A1 Dec. 15, 2011

(30) Foreign Application Priority Data

Jun. 9, 2010 (CN) ..... 2010 2 0220249

(51) Int. Cl.
*A24F 47/00* (2006.01)

(52) U.S. Cl.
USPC ..... 131/270; 131/273; 128/202.21

(58) Field of Classification Search
USPC ..... 131/270, 273; 128/202.21
See application file for complete search history.

(56) References Cited

U.S. PATENT DOCUMENTS 8,375,957 B2 * 2/2013 Hon ..... 131/194
2011/0094523 A1 * 4/2011 Thorens et al. ..... 131/194
2011/0226236 A1 * 9/2011 Buchberger ..... 128/200.23
2012/0273589 A1 * 11/2012 Hon ..... 239/128
2012/0279512 A1 * 11/2012 Hon ..... 131/329
2013/0139833 A1 * 6/2013 Hon ..... 131/273

* cited by examiner

*Primary Examiner* — Richard Crispino
*Assistant Examiner* — Dionne Walls Mayes
(74) *Attorney, Agent, or Firm* — Global IP Services; Tianhua Gu

(57) ABSTRACT

A tobacco solution atomizing device for electronic cigarette is disclosed the device comprises an atomizer installed in a fixing sleeve; a suction nozzle component and electrode connectors coupled on respective ends of the fixing sleeve, wherein the electrode connectors comprises a positive electrode connector and a negative electrode connector; the atomizer comprising a glass fiber tube, a glass fiber yarn, a heating coil, a cotton cloth layer and a synthetic fiber layer, wherein the glass fiber yarn is insert into the heating coil which is then located inside the glass fiber tube; the ends of the glass fiber silk and two wires which are used to electronically connect the heating coil to the positive and negative electrode connectors extends outward through the glass fiber tube; the cotton cloth layer enwraps the outside wall of the glass fiber tube and reveal ends of the glass fiber yarn are pressed tightly between the cotton cloth layer and the glass fiber tube; a synthetic fiber layer is filled within the annular shape space between the cotton cloth layer and the fixing sleeve for holding the tobacco solution.

8 Claims, 4 Drawing Sheets

TOBACCO SOLUTION ATOMIZING DEVICE FOR ELECTRONIC CIGARETTE

CROSS REFERENCE TO RELATED PATENT APPLICATION

The present application claims the priority of the Chinese patent application No. 201020220249.0 filed on Jun. 9, 2010, which application is incorporated herein by reference.

FIELD OF THE INVENTION

The utility model relates to an electronic cigarette field, particularly to a tobacco solution atomizing device for electronic cigarette.

BACKGROUND OF THE INVENTION

As hobby goods, cigarettes are widely favorite for people, especially to men. However, the tar in cigarettes is harmful to human health which includes dozens of carcinogenic ingredients, and secondary smoking is also very harmful to non-smokers, so most public places have smoking prohibited bans. But it is very difficult for a smoker to smoke no cigarettes. Thus, a plurality of cigarette substitutes appear in the market and the most common one is non-flammable electronic atomizing cigarette without hazardous tar.

The present electronic cigarette on the market is mostly provided with an integrated structure, of which the front end is mainly a power supply device and the rear end is an atomizing device. When the atomizing device is supplied by the power supply device, a LED light of the power supply device will be illumined to simulate the case of cigarette combustion.

A patent document (publication No. CN101228969A, filed on Jul. 30, 2008) discloses an electronic cigarette, of which an atomizing device comprises a heater fixed in an atomizing chamber; and a liquid storage core communicated with a drainage mechanism and located at the rear end of the atomizing chamber; wherein after passing through the drainage mechanism to flow into the is liquid storage core by negative pressure air flow, tobacco solution is atomized by the heater.

Another patent document (authorization No.: CN201067079Y, filed on Jun. 4, 2008) discloses a simulation aerosol inhaler, in which a tobacco solution atomizing device is consisting of an atomizer component and a cigarette bottle component, wherein the atomizer component also mainly comprises an atomizer (i.e. a heater), and the cigarette bottle component comprises a tobacco solution bottle and a suction nozzle respectively located on the both ends thereof; fibers with the tobacco solution is contained in the tobacco solution bottle; and the tobacco solution bottle is installed to resist on the atomizer.

However, the heaters of the tobacco solution atomizing device of the above electronic cigarette products do not sufficiently contact with the liquid storage core or the fibers having tobacco solution, and the drainage mechanism of the above tobacco solution atomizing device can not supply the tobacco solution in the liquid storage core or the fibers to a neighborhood of the heater for atomizing in time. Thereby, the existing electronic cigarette has the problems of low tobacco solution atomizing efficiency and small amount of atomizing tobacco.

SUMMARY OF INVENTION

The purpose of the present utility model is to solve the problem existing in the prior art by providing a tobacco solution atomizing device of simple structure and higher tobacco solution atomizing efficiency.

The technical solution of the present utility model is that a tobacco solution atomizing device for electronic cigarette that comprises: an atomizer installed in a fixing sleeve; a suction nozzle component and electrode connectors coupled on respective ends of the fixing sleeve, wherein the electrode connectors comprises a positive electrode connector and a negative electrode connector; the atomizer comprising a glass fiber tube, a glass fiber yarn, a heating coil, a cotton cloth layer and a synthetic fiber layer, wherein the glass fiber yarn is insert into the heating coil which is then located inside the glass fiber tube; the ends of the glass fiber silk and two wires which are used to electronically connect the heating coil to the positive and negative electrode connectors extends outward through the glass fiber tube; the cotton cloth layer enwraps the outside wall of the glass fiber tube and reveal ends of the glass fiber yarn are pressed tightly between the cotton cloth layer and the glass fiber tube; a synthetic fiber layer is filled within the annular shape space between the cotton cloth layer and the fixing sleeve for holding the tobacco solution.

Preferably, one end of the atomizer is coupled with a sealing is cover for preventing the tobacco solution from flowing to the electrode connectors, and the two wires pass through respective via holes on the sealing cover to reach to the electrode connectors for electronically connecting the positive and negative connectors.

Preferably, the negative connector is a screw thread bushing with an internal screw thread or an external screw thread, and the positive connector is an electrode collar; the screw thread bushing is coupled to one end of the fixing sleeve, the electrode collar is installed inside the screw thread bushing, and a insulation ring is provided between the screw thread bushing and the electrode collar to achieve electrical isolation.

Preferably, the suction nozzle component comprises: an oil blocker and a suction nozzle cover, wherein the suction nozzle cover is coupled to one end of the fixing sleeve, and the oil blocker is installed between the atomizer and the suction nozzle cover.

Preferably, the glass fiber tube comprises a tubular body, on which two narrow and long openings are provided and leading to the edge of one end of the tube body, one end of the glass fiber yarn and one wire are clamped in one of the narrow and long openings together and the other end of the glass fiber yarn and the other wire are clamped in the other narrow and long openings together, the cotton cloth layer on the external wall of the glass fiber tube enwraps the narrow and long openings.

The utility model has the advantages that the tobacco solution in the tobacco solution atomizing device is contained in the ring-shaped space formed by the cotton cloth and the fiber cotton, thus, the cotton cloth has a larger contacting area with the tobacco solution so that the tobacco solution can be immersed in the glass fiber silk continuously to achieve a quick supply of the tobacco solution; otherwise, since an electronic heating silk twists on the glass fiber silk, the electronic heating silk can atomize the tobacco solution in the glass fiber silk effectively, which can effectively solve the problem of small amount of atomizing tobacco in the existing electronic cigarette.

DETAILED DESCRIPTION OF THE INVENTION

Hereinafter, the present utility model will be further illustrated with reference to accompanying drawings.

Figure 1:
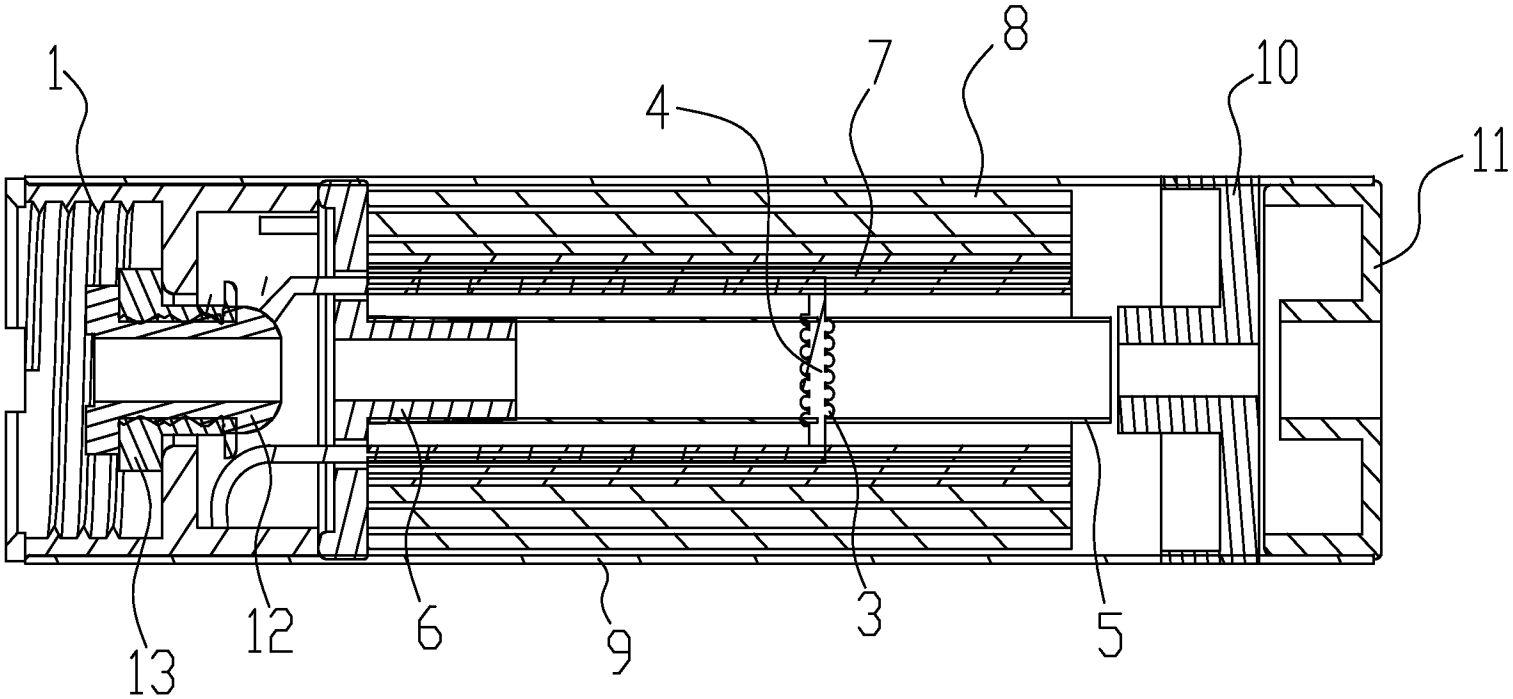
FIG. 1 is a schematic view of the tobacco solution atomizing device according to one embodiment of the present utility model.
Figure 2:
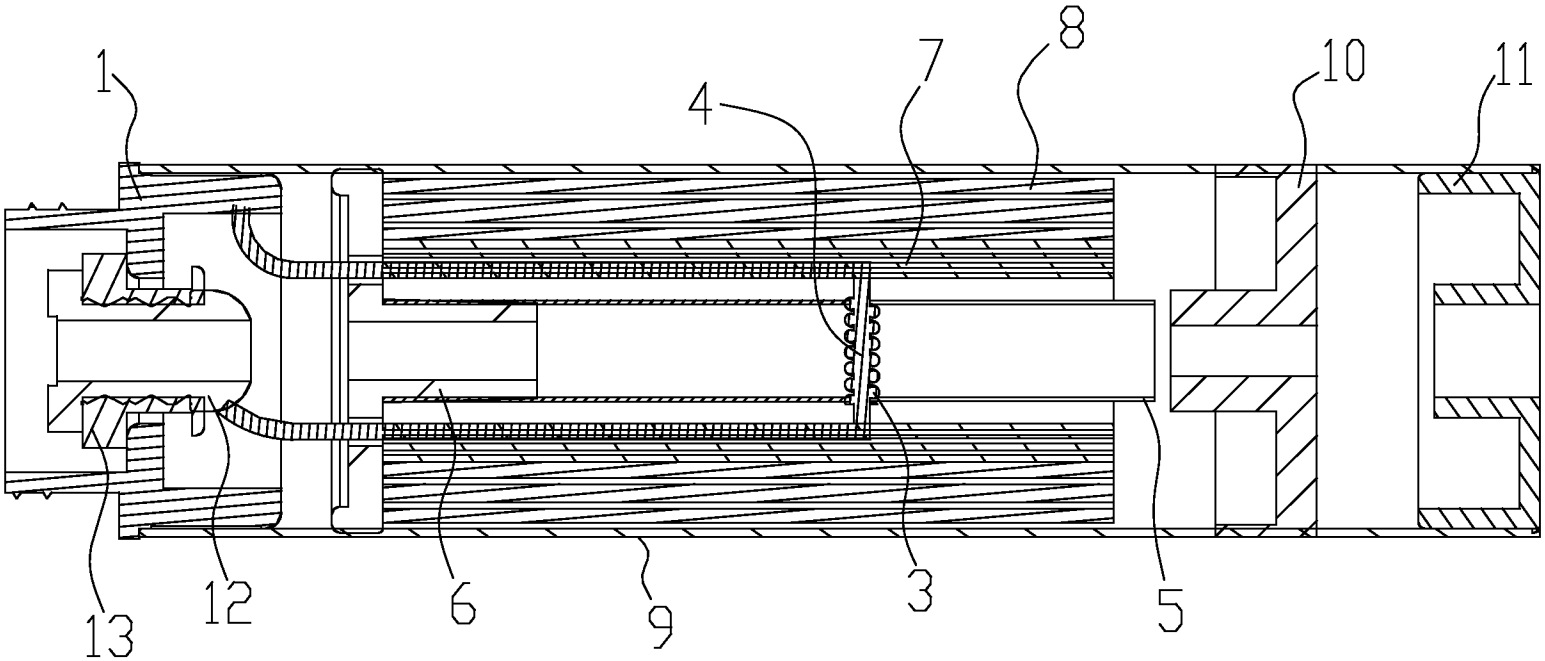
FIG. 2 is a schematic view of the tobacco solution atomizing device according to another embodiment of the present utility model.
Figure 3:
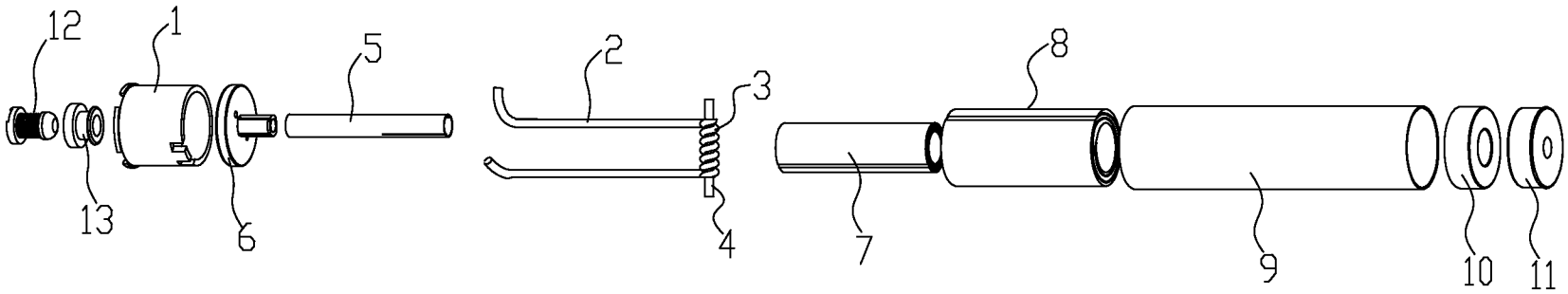
FIG. 3 is an exploded view of the tobacco solution atomizing device in FIG. 1.

Referring to FIGS. 1, 2 and 3, the tobacco solution atomizing device comprises electrode connectors, an atomizer, and a suction nozzle module, wherein the atomizer is installed in a fixing sleeve 9, and the electrode connectors and the suction nozzle module are installed on the respective ends of the fixing sleeve 9 so as to engage with the fixing sleeve 9. The electrode connectors comprise an positive connector and a negative connector which are formed by a screw thread bushing 1 and an electrode ring 12 respectively according to this embodiment, wherein the screw thread bushing 1 is coupled on one end of the fixing sleeve 9, the electrode ring 12 is coupled inside the screw thread bushing 1, and the screw thread bushing 1 is separated from the electrode ring 12 by an insulation ring 13 to achieve the isolation between the positive electrode and the negative electrode. The screw thread bushing 1 maybe an external screw thread bushing as shown in FIG. 1 or an internal screw thread bushing as shown in FIG. 2. The screw thread bushing 1 of the tobacco solution atomizing device should be screwed to connect with a screw thread bushing of a power supply of the electronic cigarette.

The atomizer 5 comprises a glass fiber tube 5, a glass fiber yarn 4, a heating coil 3, cotton cloth layer 7 and synthetic fiber layer 8. the heating coil 3 is located inside the glass fiber tube 5 with the glass fiber yarn 4 is insert there through; the ends of the glass fiber yarn 4 together with the wires 2 for connecting the heating coil 3 to a power supply loop are all protrude outward through the glass fiber tube 5; the cotton cloth layer 7 id formed by enwrapping a piece of cotton cloth around the external wall of the glass fiber tube 5 and during which process the protrude ends of the glass fiber yarn 4 are pressed tightly between the cotton cloth layer 7 and the glass fiber tube 5, that is the cotton cloth 7 enwraps the glass fiber tube tightly so as to achieve a close engagement .Moreover, the cotton cloth 7 can effectively prevent the tobacco solution from flowing into the glass fiber tube 5 since that the tobacco solution is of a certain viscidity and that the openings formed on the glass fiber tube 5 for the protruding of the glass fiber yarn 4 and the wires 2 can be sealed up the cotton cloth 7. The synthetic fiber layer 8 enwraps around the external wall of the cotton cloth layer 7, the tobacco solution is thus hold in the synthetic fiber layer 8 (a ring space) which is enwrapped by the fixing sleeve 9. The embodiment can avoid leakage of the tobacco solution by absorption of the fiber cotton 8. One end of the atomizer is provided with a sealing cap 6 which is coupled to an opening of the glass fiber tube 5, and a portion of the sealing cap 6 is tightly engaged with the internal wall of the fixing sleeve 9 to prevent the tobacco solution from flowing to the electrode connectors; and the two wires connecting the heating coil 3 pass through respective via holes on the sealing cover 6 with the electrode connectors for electronically connecting with the screw thread bushing 1 and the electrode ring 12 respectively, so that when the screw thread bushing 1 and the electrode ring 12 are connected to an external power supply, the power supply can provide power to the heating coil 3. Here, after the wires 2 extend through the via holes on the sealing cover 6, the via hole needs to be sealed by sealing material such as silica gel.

Figure 4:
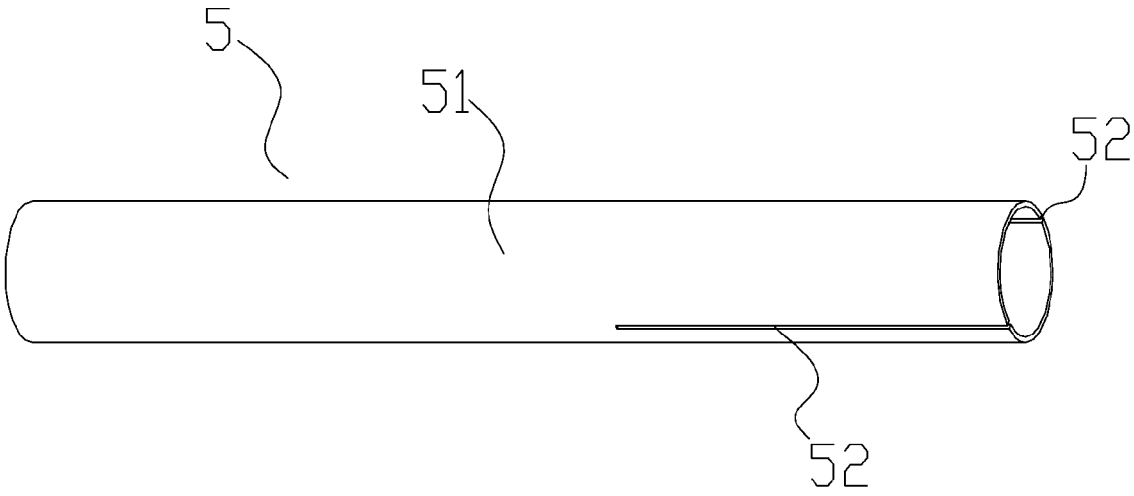
FIG. 4 is a schematic view of the glass fiber tube in FIGS. 1 and 3.

In order to facilitate inserting the heating coil 4 into the glass tube 5, and to facilitate extending the ends of glass fiber yarn 4 and the wires 2 out of the glass tube 5, the glass tube 5 can adopt the structure shown in FIG. 4, in which the glass fiber tube 5 comprises a tube body 51, two narrow and long openings 52 provided on the tubular wall of the tube body 51 and leading to the edge of the upper edge of the tube body 51, one end of the glass fiber yarn and one wire are blocked in one of the narrow and long openings 52 together and the other end of the glass fiber yarn and the other wire are blocked in the other narrow and long openings 52, and the glass fiber yarn 4 and the wires 2 are moved downward to the closed end of the narrow and long openings 52 to fix the heating yarn 4 in the glass fiber tube 5. Since the width of the narrow and long openings 52 is very small, the glass fiber yarn 4 and the wires 2 are in interference fit with narrow and long openings 52, so that can completely prevent the tobacco solution from flowing into the glass fiber tube 5 by passing through the narrow and long openings 52 due to the enwrapped effect of the cotton cloth 7 and the adhesive effect of the tobacco solution.

The suction nozzle component comprises an oil blocker 10 and a suction nozzle cover 11, wherein the suction nozzle cover 11 is coupled to one end of the fixing bushing 9, and the oil blocker 10 is coupled between the atomizer and the suction nozzle cover 11. The oil blocker 10 is used to prevent the tobacco solution from flowing out with the suck action during smoking, and the suction nozzle cover 11 is further used to prevent smokers from drawing in tobacco solution.

The above description is only the preferred embodiments according to the present utility model; it is not intent to limit the implementing scope. That is to say that such changes and modifications according to the content of the application scope of the utility model all fall in the technical scope of the utility model.

What is claimed is:

1. A tobacco solution atomizing device for electronic cigarette comprising:

an atomizer installed in a fixing sleeve; and a suction nozzle component and electrode connectors coupled on respective ends of the fixing sleeve;

wherein the electrode connectors comprise a positive electrode connector and a negative electrode connector;

wherein the atomizer comprises a glass fiber tube, glass fiber yarn having ends, two wires, a heating coil, a cotton cloth layer and a synthetic fiber layer;

wherein the glass fiber yarn is inserted into the heating coil which is located inside the glass fiber tube;

wherein the ends of the glass fiber yarn and two wires extending outwardly through the glass fiber tube and electronically connect the heating coil to the positive and negative electrode connectors;

wherein the cotton cloth layer enwraps an outside wall of the glass fiber tube, and reveals ends of the glass fiber yarns which are pressed tightly between the cotton cloth layer and the glass fiber tube; and wherein the synthetic fiber layer is filled within an annular shape between the cotton cloth layer and the fixing sleeve for holding the tobacco solution.

2. The device according to claim 1, wherein one end of the atomizer is coupled with a sealing cover for preventing the tobacco solution from flowing to the electrode connectors, and the two wires pass through respective holes on the sealing cover to reach the electrode connectors for electronically connecting the positive and negative connectors.

3. The device according to claim 2, wherein the glass fiber tube comprises a tubular body, on which two narrow and long openings are provided and lead to the edge of one end of the tube body; wherein one end of the glass fiber yarn and one wire are clamped in one of the narrow and long openings together and the other end of the glass fiber yarn and the other wire are clamped in the other narrow and long openings together; and wherein the cotton cloth layer on the outside wall of the glass fiber tube enwraps the narrow and long openings.

4. The device according to claim 2, wherein the negative connector is a screw thread bushing with an internal screw thread or an external screw thread, and the positive connector is an electrode collar; and wherein the screw thread bushing is coupled to one end of the fixing sleeve, the electrode collar is installed inside the screw thread bushing, and an insulation ring is provided between the screw thread bushing and the electrode collar to achieve electrical isolation.

5. The device according to claim 4, wherein the glass fiber tube comprises a tubular body, on which two narrow and long openings are provided which lead to the edge of one end of the tube body; wherein one end of the glass fiber yarn and one of the two wires are clamped in one of the narrow and long openings together and the other end of the glass fiber yarn and the other of the two wires are clamped in the other of the narrow and long openings together; and wherein the cotton cloth layer on the outside wall of the glass fiber tube enwraps the narrow and long openings.

6. The device according to claim 1, wherein the suction nozzle component comprises an oil blocker and a suction nozzle cover, the suction nozzle cover being coupled to one end of the fixing sleeve, and the oil blocker being installed between the atomizer and the suction nozzle cover.

7. The device according to claim 6, wherein the glass fiber tube comprises a tubular body, on which two narrow and long openings are provided which lead to the edge of one end of the tube body; wherein one end of the glass fiber yarn and one of the two wires are clamped in one of the narrow and long openings together and the other end of the glass fiber yarn and the other of the two wires are clamped in the other of the narrow and long openings together; and wherein the cotton cloth layer on the outside wall of the glass fiber tube enwraps the narrow and long openings.

8. The device according to claim 1, wherein the glass fiber tube comprises a tubular body, on which two narrow and long openings are provided and lead to the edge of one end of the tube body; wherein one end of the glass fiber yarn and one wire are clamped in one of the narrow and long openings together and the other end of the glass fiber yarn and the other wire are clamped in the other narrow and long openings together; and wherein the cotton cloth layer on the outside wall of the glass fiber tube enwraps the narrow and long openings.

* * * * *